United States Patent [19]

Goldhagen et al.

[11] 4,050,968

[45] Sept. 27, 1977

[54] EXPLOSIVE COMPOSITION CONTAINING A HYDROXYALKYL ACRYLATE COPOLYMER BINDER

[75] Inventors: Samuel Goldhagen, Sacramento, Calif.; Harry Heller, Silver Spring, Md.; Julius Rothenstein, Citrus Heights, Calif.

[73] Assignee: The United States of America as represented by the Secretary of the Navy, Washington, D.C.

[21] Appl. No.: 29,623

[22] Filed: Apr. 29, 1970

[51] Int. Cl.[2] ..... C06B 45/10

[52] U.S. Cl. ..... 149/19.4; 149/19.91; 149/20; 149/22; 149/92

[58] Field of Search ..... 149/19, 22, 38, 40, 149/44, 76, 56, 60, 62, 78, 83, 92, 105, 61, 19.91, 19.4

[56] References Cited

U.S. PATENT DOCUMENTS

| | | | |
|---|---|---|---|
| 3,260,631 | 7/1966 | Witz et al. | 149/19 X |
| 3,305,523 | 2/1967 | Burnside | 149/19 X |
| 3,428,502 | 2/1969 | Evans | 149/19 |
| 3,447,980 | 6/1969 | Voigt | 149/19 |
| 3,480,490 | 11/1969 | Finger et al. | 149/92 |

*Primary Examiner*—Edward A. Miller

*Attorney, Agent, or Firm*—R. S. Sciascia; A. L. Branning

[57] ABSTRACT

A readily castable explosive composition comprising (1) an explosive such as RDX, HMX or perchlorate salts, (2) a readily curable elastomeric polymer such as a copolymer of 2,2-dinitropropyl acrylate, methyl acrylate and at least one member of the group 2-hydroxypropyl acrylate, 2-hydroxyethyl methacrylate, 2-hydroxypropyl methacrylate and 2-hydroxyethyl acrylate, (3) a diluent or plasticizer such as bis(2,2-dinitropropyl)formal and/or bis(2,2-dinitropropyl)acetal and (4) a cross-linking agent such as 2,4-toluene diisocyanate and polymethylene polyphenylisocyanate and optionally containing one or more of the following: fuels, stabilizers, antioxidants, polymerization catalysts and explosive desensitizers.

16 Claims, No Drawings

EXPLOSIVE COMPOSITION CONTAINING A HYDROXYALKYL ACRYLATE COPOLYMER BINDER

BACKGROUND OF THE INVENTION

This invention generally relates to explosive compositions and more particularly to explosive compositions which are readily castable.

Presently available high energy explosives having high detonation pressures and high detonation energies are generally categorized as compositions which either cannot be cast in place due to the high volume percent of solids (explosive) required to attain these energy levels (they are usually processed by compression molding) or are not thermally stable beyond 100° C because of low melting or highly volatile binder components. Other known explosive compositions are castable and thermally stable, but have inadequate explosive energy for many applications. Additionally, it is often desirable to have an explosive composition which can be cast in place at mild, ambient temperatures, which will cure at mild, ambient temperatures to a crosslinked polymeric structure, which exhibit very low degrees of shrinkage and which has glass transition temperatures below −65° F.

Heretofore, the prior art has searched for explosive compositions which possess some or all of the above properties but all known compositions have left much room for improvement.

SUMMARY OF THE INVENTION

Accordingly, one object of this invention is to provide an explosive composition.

Another object of this invention is to provide an explosive composition which has a relatively high detonation pressure and detonation energy.

A still further object of this invention is to provide an explosive composition which is thermally stable (gas evolution is about 2 cc/gram after 48 hours at 120° C) and can be cast in place at mild, ambient temperatures.

A still further object of this invention is to provide an explosive composition which can be cured at mild ambient temperatures to a crosslinked polymeric structure, exhibits a very low degree of shrinkage and has a glass transition temperature below about −65° F.

These and other objects are accomplished by providing explosive compositions comprising (1) an explosive material, (2) a readily curable elastomeric polymer, (3) a diluent or plasticizer and (4) a crosslinking agent and optionally containing fuels, stabilizers, antioxidents, polymerization catalysts and explosive desensitizers. Furthermore, as one replaces the explosive material with the diluent or plasticizer the castability of the explosive composition increases.

DESCRIPTION OF THE PREFERRED EMBODIMENT

Explosive compositions with the properties hereinbefore enumerated are obtained by incorporating explosives into readily curable, elastomeric polymers that are highly compatible with large concentrations of stable, energetic liquid diluents or plasticizers which are themselves tenaciously retained by the cured, crosslinked polymer network even at high temperatures, without significant decomposition. Since a high concentration of diluent must be included in a highly loaded explosive composition to render it readily castable, it is necessary that the diluent itself be sufficiently energetic to minimize the energy loss due to its inclusion to replace a portion of the explosive. Moreover, it must be compatible with the binder system in such concentration as is required to maintain energy and impart castability, yet be retained after cure without loss, and be sufficiently stable to withstand decomposition at high temperatures.

The explosives which can be used in the composition of the instant invention and which comprise from about 50 to about 95% of the composition include all the well known explosives of the prior art. Thus, one can use nitramines such as, but not limited to, RDX (syn-cyclotrimethylene trinitramine) and HMX (cyclotetramethylene tetranitramine); perchlorates such as, but not limited to, potassium perchlorate and ammonium perchlorate; nitrates such as, but not limited to, ammonium, potassium, hydrazine and lithium nitrate; aromatic nitrocompounds such as, but not limited to, TNT. The preferred embodiments of this invention utilize RDX, HMX and perchlorate explosives although this invention is applicable to other explosives as well.

The readily curable elastomeric polymers of this composition which make up from about 5 to about 30% of the composition when combined with the curing agent can be prepared either by solution polymerization or emulsion polymerization.

EXAMPLE I

SOLUTION POLYMERIZATION

A series of 10 polymers were prepared by using the conventional solution polymerization techniques. Fifty percent dichlorobenzoyl peroxide, compounded with dibutyl phthalate to give a non-separating paste was used as the free radical initiator. The initiator was removed at the termination of the reactions by extraction with aqueous 2% sodium thiosulfate solution. The first four attempts, two in which 1% initiator with methyl ethyl ketone solvent were used, and two in which 1.5% initiator with methyl isobutyl ketone (MIBK) solvent were used gave little polymerization after 16 hours at 50° C. Starting with HEA-5, all polymerizations were conducted at 65° C for 5 hours with MIBK solvent and 1.5% dichlorobenzoyl peroxide. The reactions were all exothermic and leveled off to a constant viscosity in approximately 1 hour. Solvents were stripped from the polymers at 65° C and a vacuum of 0.1 mm Hg or less was maintained until the weight of the residue became constant. Sample HPA-6B was purified by precipitation from MIBK and gave a molecular weight of 1000 compared to 540 without this step. Table I indicates the results of the solution polymerizations.

TABLE I

SOLUTION POLYMERIZATION OF DINITROPROPYL ACRYLATE-METHYL ACRYLATE-HYDROXY ALKYL ACRYLATES (U)

| Designation | Mole Ratio of Reactants Hydroxy Alkyl Acrylate* | | | | | | ** DCBP % | Solvent | Polymer/Solvent Ratio | Reaction Temp. °C | Reaction Time, hr | Theo. Eq.Wt | MW Avg. | Characteristics |
|---|---|---|---|---|---|---|---|---|---|---|---|---|---|---|
| | DNPA | MA | HEA | HPA | HEMA | HPMA | | | | | | | | |
| HEA-1 | 7 | 1 | 2 | — | — | — | 1.0 | MEK | 1/1 | 50 | 16 | 873 | — | Fluid, yellow-orange |
| HEA-2 | 7 | 1 | 1 | — | — | — | 1.0 | MEK | ↓ | ↓ | ↓ | 1626 | — | Fluid, yellow-orange |

TABLE I-continued

SOLUTION POLYMERIZATION OF DINITROPROPYL ACRYLATE-METHYL ACRYLATE-HYDROXY ALKYL ACRYLATES (U)

| Designation | Mole Ratio of Reactants Hydroxy Alkyl Acrylate* DNPA | MA | HEA | HPA | HEMA | HPMA | ** DCBP % | Solvent | Polymer/ Solvent Ratio | Reaction Temp. °C | Time, hr | Theo. Eq.Wt | MW Avg. | Characteristics |
|---|---|---|---|---|---|---|---|---|---|---|---|---|---|---|
| HEA-3 | 7 | 1 | 2 | — | — | — | 1.5 | MIBK | | | | 873 | — | Fluid, yellow-orange |
| HEA-4 | 7 | 1 | 1 | — | — | — | | | | | | 1626 | — | Fluid, yellow-orange |
| HEA-5 | 7 | 1 | 1 | — | — | — | | | 5/3 | 65 | 5 | 1626 | 690 | High, yellow-orange viscosity |
| HPA-6A | 7 | 1 | — | 1 | — | — | | | | | | 1645 | 540 | Med viscosity-yellow |
| HPA-6B | 7 | 1 | — | 1 | — | — | | | | | | — | 1000 | High viscosity, yellow-orange |
| HEMA-7 | 7 | 1 | — | — | 1 | — | | | | | | 1645 | 490 | med viscosity, yellow |
| HPMA-8 | 7 | 1 | — | — | — | 1 | | | | | | 1658 | 470 | Low viscosity, yellow |
| HPMA-9 | 14 | 2 | — | — | — | 2 | | | | | | 3176 | 470 | Low viscosity, yellow |
| HPMA-10 | 7 | 1 | — | — | — | 2 | | | | | | 901 | 450 | Low viscosity yellow |

*DNPA - 2,2-dinitropropyl acrylate
MA - methyl acrylate
HEA - 2-hydroxyethyl acrylate
HPA - 2-hydroxypropyl acrylate
HEMA - 2-hydroxyethyl methacrylate
HPMA - 2-hydroxypropyl methacrylate
**dichlorobenzoyl peroxide

EXAMPLE II

EMULSION POLYMERIZATION

In the emulsion polymerizations the three monomers were mixed with a 1% aqueous solution of dispersing agent and surfactant. After a nitrogen purge and sweep, the catalysts were added and the mixture stirred for 1 hour after the exotherm. The emulsion is then broken to precipitate the polymer in the conventional manner. Water is added and the product filtered, washed with methanol, twice with water and dried. Typical results are given in Table II.

TABLE II

EMULSION POLYMERIZATION OF DINITROPROPYL ACRYLATE - METHYL ACRYLATE - HYDROXETHYL OR HYDROXYPROPYL ACRYLATE*

| Batch | Mole Ratio DNPA | MA | HEA | HPA | g catalyst | M.W.** |
|---|---|---|---|---|---|---|
| 1 | 0.8 | 0.1 | 0.2 | — | 3.25 | 4590 |
| 2 | 0.8 | 0.1 | 0.2 | — | 6.50 | 3380 |
| 3 | 0.8 | 0.1 | — | 0.2 | 6.50 | — |

*1% by weight dichlorobenzoyl peroxide initiator
**Molecular weight by vapor phase osmometry Another series of emulsion polymerizations were run using various thiols as chain transfer agents in an attempt to obtain lower molecular weights than above. The results are tabulated in Table III.

TABLE III

EFFECT OF CHAIN TRANSFER AGENTS ON EMULSION POLYMERS OF DNPA, MA AND HEA*

| Thiol Name | By wt. of Monomer | Product Yield % | Mol. wt. |
|---|---|---|---|
| None | — | 66.5 | 14,700 |
| Benzene | 0.4 | 63.5 | 2,730 |
| Benzene | 4.0 | 62.0 | 2,210 |
| Dodecane | 0.4 | 60.5 | 6,250 |
| Ethanol | 0.4 | 35.6 | 11,300 |
| Butane | 0.4 | 77.0 | 3,990 |
| Propane | 0.4 | 30.4 | 1,910 |

*1% by weight dichlorobenzoyl peroxide initiator

In all of the experiments in Table III the molar ratio of DNPA/MA/HEA was 8/1/2; after the catalyst addition of 60° C, the reaction mixture was post stirred one hour before isolation and purification. The molecular weights were determined by vapor phase osmometry.

For the purposes of the instant composition the preferred range of molecular weights for the readily curable elastomeric polymer is from about M.W. = 2000 to 3500, although polymers with various other molecular weights can be used (mw = 450–4600).

The diluents or plasticizers which can be used in the instant composition and which make up from about 3 to about 25% of the composition, are those which are compatible with the above readily curable elastomeric polymer and which are sufficiently energetic to contribute substantially to the energy release upon detonation. The preferred diluents or plasticizers are bis(2,2-dinitropropyl) formal (BDNPF) and bis(2,2-dinitropropyl)acetal (BDNPA) and mixtures thereof. However, a somewhat larger group of diluents or plasticizers can be used and these are represented by the formula

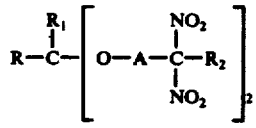

wherein R is a hydrogen or an alkyl radical; $R_1$ is a hydrogen or an alkyl radical; $R_2$ is a hydrogen, alkyl, halogen, nitroalkyl, aryl, cycloalkyl, haloalkyl or nitrazaalkyl radical; and A is an alkylene radical. The preferred species of this diluent or plasticizer as well as the method of preparation of these compounds is disclosed in U.S. Pat. No. 3,291,833 to Gold and Marcus the teaching of which is hereby incorporated by reference.

The preferred curing agents of this invention are polymethylene polyphenylisocyanate (PAPI), 2,4-toluene diisocyanate (TDI) and a mixture of toluene diisocyanate and trimethylol propane (TDI/TMP) although a much wider range of curing agents is available. It will be appreciated by those skilled in the art that any polyfunctional isocyanate can be used as a curing agent. Examples of various binder compositions after ambient cures are given in Table IV. It will be further recognized by those skilled in the art that curing can be accomplished at temperatures both above and below ambient temperature.

TABLE IV

BINDERS FROM HYDROXYL-CONTAINING DINITROPROPYL acrylate POLYMERS PLASTICIZED WITH 1:1 BDNPF/A (U)

| Binder No. | DNPA/MA/HEA[1] Prepolymer MW = 3380 | 2730 | 2210 | Nitroplast. by weight Binder, % | TMP Equiv. | TDI Equiv. | Shore A Hardness o 6 days at 77° F |
|---|---|---|---|---|---|---|---|
| 1 | 100 | — | — | 66.7 | — | 130 | 6 |
| 2 | 100 | — | — | 66.7 | — | 150 | 8 |
| 3 | 100 | — | — | 66.7 | — | 100 | 10 |
| 4 | 100 | — | — | 66.7 | — | 75 | 6 |
| 5 | 100 | — | — | 66.7 | — | 60 | 7 |
| 6 | 100 | — | — | 75.0 | — | 100 | 4 |
| 7 | 70 | — | — | 75.0 | 30 | 107 | 4 |
| 8 | — | 100 | — | 75.0 | — | 135 | 5 |
| 9 | — | 100 | — | 75.0 | — | 68 | 4 |
| 10 | — | 100 | — | 75.0 | — | 47 | 1 |
| 11 | — | 100 | — | 75.0 | — | 38 | 0.5 |
| 12 | — | — | 100 | 75.0 | — | 100 | 0 gelled[2] |
| 13 | — | — | 70 | 75.0 | 30 | 107 | 0 gelled[2] |
| 14 | — | — | 45 | 75.0 | 55 | 107 | 0 gelled[2] |

[1]Mole ratio 8 DNPA:1 MA:2 HEA
[2]Eventually cured

Additionally any one or combination of additional materials may be added to the basic explosive composition. Thus, metallic fuels such as aluminum, aluminum oxide, boron or magnesium can be added as can antioxidants or stabilizing agents such as phenylbetanaphthylamine, explosive desensitizers such as dioctyl adipate (DOA) amd polymerization catalysts such as Ferric 2-ethylhexoate, ferric chloride, ferric acetylacetonate, dibutyltin sulfide, dibutyltin acetylacetonate, dibutyltin dibutoxide, dibutyltin maleate, dibutyltin di-o-phenylphenate, dibutyltin dilaurate, dibutyltin diacetate, dibutyltin di-2-ethylhexonate, stannous oleate, stannous 2-ethylhexanoate, stannous chloride, tetra-2-ethylhexyl titanate and all of the catalysts listed in Industrial and Engineering Chemistry — Product Research and Development, Volume 1, No. 4 at page 261 (December 1962) which list is herein incorporated by reference.

The compositions of this invention can be conveniently mixed by first dissolving the elastomer, trimethyol propane (if used), antioxidant (if used) and polymerization catalyst (if used) in the diluent or plasticizer at about 140°-150° F. Then, the submix solution is preferably cooled to ambient temperature and charged into a convenient blender or mixer. If a metal fuel is desired it is blended into the submix now and the submix is degassed briefly. The explosive is thereafter added and mixed under vacuum till an even blend is obtained. The isocyanate curing agent is subsequently blended in under vacuum prior to casting. The curing takes place at ambient temperatures.

It will be recognized that the binders listed in Table IV contain three of the four ingredients which comprise the explosive compositions of this invention. To obtain the compositions of this invention one merely adds the explosive material to be used to the binder before cure and then proceeds to cure the mixture.

A few typical compositions which were prepared are as follows:

| | | |
|---|---|---|
| HMX Class D (0.5% DOA) | 40.25 | 40.25 |
| HMX Class A (0.5% DOA) | 24.96 | 24.96 |
| HMX Class E (0.5% DOA) | 15.29 | 15.29 |

-continued

| | | |
|---|---|---|
| DNPA polymer/TMP/TDI* | 5.07 | |
| DNPA polymer/TDI** | | 5.07 |
| 1:1 BDNPF/A | 14.43 | 14.43 |

*binder 7 before cure
**binder 9 before cure

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A cured explosive composition comprising (1) an explosive, (2) a readily curable elastomeric polymer which is derived from 2,2-dinitropropyl acrylate and at least one hydroxy alkyl acrylate; (3) a diluent or plasticizer selected from the group consisting of diluents or plasticizers represented by the formula

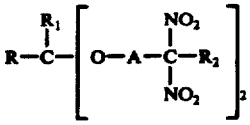

wherein R is hydrogen or alkyl; $R_1$ is hydrogen or alkyl; $R_2$ is hydrogen, alkyl, halogen, nitroalkyl, aryl, cycloalkyl, haloalkyl or nitrazaalkyl; and A is alkylene; and (4) a polyisocyanate curing agent.

2. The composition of claim 1 which additionally contains a member selected from the group consisting of fuels, stabilizers, antioxidants, polymerization catalysts, explosive desensitizers and mixtures thereof.

3. An explosive composition according to claim 1 wherein said readily curable elastomeric polymer is a polymer of 2,2-dinitropropyl acrylate, methyl acrylate and at least one member selected from the group consisting of 2-hydroxyethylacrylate, 2-hydroxypropyl acrylate, 2-hydroxyethyl methacrylate and 2-hydroxypropyl methacrylate.

4. The composition of claim 3 which additionally contains a member selected from the group consisting of fuels, stabilizers, antioxidants, polymerization catalysts, explosive desensitizers and mixtures thereof.

5. An explosive composition according to claim 1 wherein said explosive is selected from the group consisting of RDX, HMX and perchlorate salts; wherein said readily curable elastomeric polymer is a polymer of 2,2-dinitropropylacrylate, methylacrylate and at least one member selected from the group consisting of 2-hydroxyethylacrylate, 2-hydroxypropyl acrylate, 2-hydroxyethyl methacrylate and 2-hydroxypropyl methacrylate; wherein said diluent or plasticizer is selected from the group consisting of bis(2,2-dinitropropyl) formal, bis(2,2-dinitropropyl) acetal and mixtures thereof; wherein said curing agent is selected from the group consisting of (a) 2,4-tolylene diisocyanate, (b) 2,4-tolylene diisocyanate and trimethylol propane and (c) polymethylene polyphenylisocyanate.

6. An explosive composition according to claim 5 which additionally contains a member selected from the group consisting of aluminum, aluminum oxide, boron, magnesium, dioctyl adipate explosive desensitizer, phenylbetanaphthylamine stabilizer or antioxidant, thiol chain transfer agents, polymerization catalysts and mixtures thereof.

7. An explosive composition according to claim 6 which comprises: (1) HMX as the explosive; (2) a copolymer of 2,2-dinitropropyl acrylate, methyl acrylate and 2-hydroxyethyl acrylate as the readily curable elastomeric polymer; (3) a mixture of bis(2,2-dinitropropyl)-formal and bis(2,2-dinitropropyl)acetal as the diluent or plasticizer; (4) trimethylol propane and 2,4-tolylene diisocyanate as the curing agents and (5) dioctyl adipate as the explosive desensitizer.

8. An explosive composition according to claim 6 which comprises: (1) HMX as the explosive; (2) a copolymer of 2,2-dinitropropyl acrylate, methyl acrylate and 2-hydroxyethyl acrylate as the readily curable elastomeric polymer; (3) a mixture of bis(2,2-dinitropropyl) formal and bis(2,2-dinitropropyl)acetal as the diluent or plasticizer; (4) 2,4-tolylene diisocyanate as the curing agent; and (5) dioctyl adipate as the explosive desensitizer.

9. The composition of claim 1 wherein said explosive constitutes 50–95 weight percent of the composition, said diluent or plasticizer constitutes 3–25 weight percent of the composition and said readily curable elastomeric polymer plus said polyisocyanate curing agent constitutes 5–30 weight percent of the composition.

10. The composition of claim 9 which additionally contains a member selected from the group consisting of fuels, stabilizers, antioxidants, polymerization catalysts, explosive desensitizers and mixtures thereof.

11. An explosive composition according to claim 9 wherein said readily curable elastomeric polymer is a polymer of 2,2-dinitropropyl acrylate, methyl acrylate and at least one member selected from group consisting of 2-hydroxyethylacrylate, 2-hydroxypropyl acrylate, 2-hydroxyethyl methacrylate and 2-hydroxypropyl methacrylate.

12. The composition of claim 11 which additionally contains a member selected from the group consiting of fuels, stabilizers, antioxidants, polymerization catalysts, explosive desensitizers and mixtures thereof.

13. An explosive composition according to claim 9 wherein said explosive is selected from group consisting of RDX, HMX and perchlorate salts; wherein said readily curable elastomeric polymer is a polymer of 2,2-dinitropropylacrylate, methylacrylate and at least one member selected from the group consisting of 2-hydroxyethylacrylate, 2-hydroxypropyl acrylate, 2-hydroxyethyl methacrylate and 2-hydroxypropyl methacrylate; wherein said diluent or plasticizer is selected from the group consisting of bis(2,2-dinitropropyl) formal, bis(2,2-dinitropropyl) acetal and mixtures thereof; wherein said curing agent is selected from the group consisting of (a) 2,4-tolylene diisocyanate, (b) 2,4-tolylene diisocyanate and trimethylol propane and (c) polymethylene polyphenylisocyanate.

14. An explosive composition according to claim 13 which additionally contains a member selected from the group consisting of aluminum, aluminum oxide, boron, magnesium, dioctyl adipate explosive desensitizer, phenylbetanaphthylamine stabilizer or antioxidant, thiol chain transfer agents, polymerization catalysts and mixtures thereof.

15. An explosive composition according to claim 14 which comprises: (1) HMX as the explosive; (2) a copolymer of 2,2-dinitropropyl acrylate, methyl acrylate and 2-hydroxyethyl acrylate as the readily curable elastomeric polymer; (3) a mixture of bis(2,2-dinitropropyl) formal and bis(2,2-dinitropropyl) acetal as the diluent or plasticizer; (4) trimethylol propane and 2,4-tolylene diisocyanate as the curing agents and (5) dioctyl adipate as the explosive desensitizer.

16. An explosive composition according to claim 14 which comprises: (1) HMX as the explosive; (2) a copolymer of 2,2-dinitropropyl acrylate, methyl acrylate and 2-hydroxyethyl acrylate as the readily curable elastomeric polymer; (3) a mixture of bis (2,2-dinitropropyl) formal and bis(2,2-dinitropropyl) acetal as the diluent or plasticizer; (4) 2,4-tolylene diisocyanate as the curing agent; and (5) dioctyl adipate as the explosive desensitizer.

* * * * *